US006581767B2

(12) United States Patent
Cheng

(10) Patent No.: US 6,581,767 B2
(45) Date of Patent: Jun. 24, 2003

(54) GOLF BAG BASE

(76) Inventor: Wen-Chien Cheng, P.O. Box 453, Taichung (TW)

( * ) Notice: Subject to any disclaimer, the term of this patent is extended or adjusted under 35 U.S.C. 154(b) by 0 days.

(21) Appl. No.: 09/931,739

(22) Filed: Aug. 20, 2001

(65) Prior Publication Data

US 2003/0034262 A1 Feb. 20, 2003

(51) Int. Cl.[7] ..... A63B 55/04; A63B 55/00
(52) U.S. Cl. ..... 206/315.7; 248/96
(58) Field of Search ..... 206/315.7; 248/96; 220/760, 840, 842; 16/423

(56) References Cited

U.S. PATENT DOCUMENTS 4,029,248 A * 6/1977 Lee ..... 16/423
5,857,567 A * 1/1999 Cheng ..... 206/315.7
6,620,433 * 4/2001 Kang ..... 206/315.7
6,264,028 B1 * 7/2001 Wu ..... 206/315.3
6,325,208 B1 * 12/2001 Cheng ..... 206/315.7
6,435,345 B1 * 8/2002 Wang ..... 206/315.7

* cited by examiner

*Primary Examiner*—Tri M. Mai
(74) *Attorney, Agent, or Firm*—Harrison & Egbert

(57) ABSTRACT

A golf bag base is formed of a main body and an action plate. The main body has an inclined underside and a horizontal underside which is provided with a receiving slot. The receiving slot is provided in the inner wall with two pivoting holes. The action plate is provided with two pivoting projections and is pivoted to the main body such that the two pivoting projections are received in the two pivoting holes of the receiving slot of the main body.

2 Claims, 11 Drawing Sheets

GOLF BAG BASE

BACKGROUND OF THE INVENTION

1. Field of the Invention

The present invention relates generally to a golf bag, and more particularly to a base of the golf bag.

2. Description of Related Art

As shown in FIGS. 1 and 2, a golf bag base 10 of the prior art is provided with a horizontal underside 11 and an inclined underside 12. The horizontal underside 11 is provided with a locating slot 111 and is capable of cooperating with an action plate 13 by a pivoting member 14 which is located in the locating slot 111 and is provided with a pivoting hole 141. The action plate 13 is provided with a pivoting hole 131 and a retaining block 132. The action plate 13 is fastened pivotally with the pivoting member 14 by a pivot 15 which is received in the pivoting hole 141 of the pivoting member 14 and the pivoting hole 131 of the action plate 13. The retaining block 132 of the action plate 13 is intended to retain a drive rod 16 of the golf bag.

When the golf bag is tilted, the action plate 13 swivels to stay close to the inclined underside 12, as shown in FIG. 2. The drive rod 16 is thus activated.

Such a prior art golf bag base 10 as described above is defective in design in that it is complicated in construction, and that it is not cost-effective, and further that its rejection rate is relatively high.

BRIEF SUMMARY OF THE INVENTION

The primary objective of the present invention is to provide a novel golf bag base which is free of the deficiencies of the prior art golf bag base described above.

In keeping with the principle of the present invention, the foregoing objective of the present invention is attained by a golf bag base comprising a main body and an action plate pivoted to the main body. The main body is provided with a horizontal underside and an inclined underside, one of which is provided with a receiving slot. The receiving slot is provided in the inner wall with two pivoting holes opposite in location to each other. The action plate is provided with two pivoting projections opposite in location to each other. The action plate is pivoted to the main body such that the two pivoting projections of the action plate are respectively engaged with the two pivoting holes of the receiving slot of the main body.

The foregoing objective, features, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
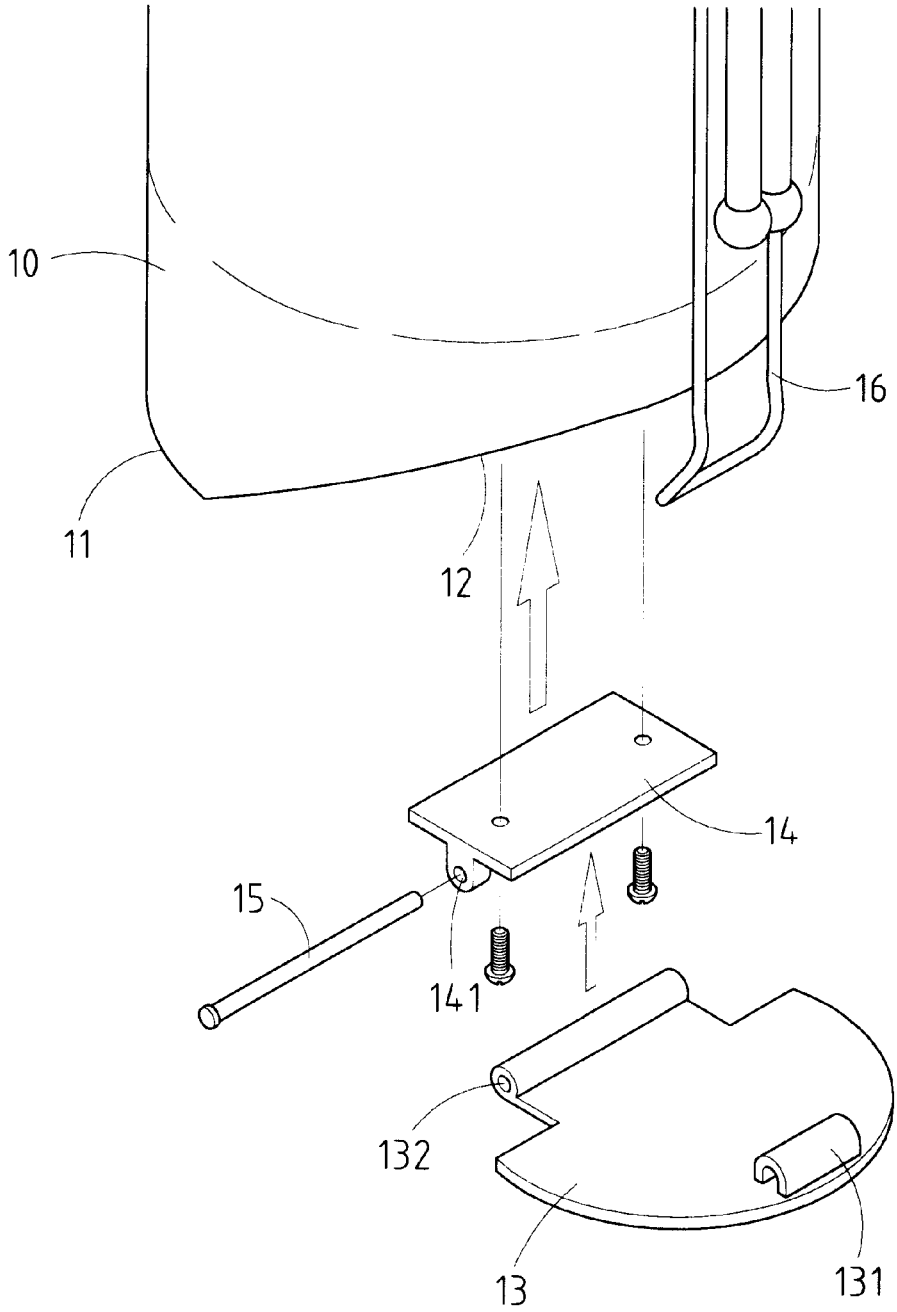
FIG.1 PRIOR ART
FIG. 1 shows an exploded view of a golf bag base of the prior art.
Figure 2:
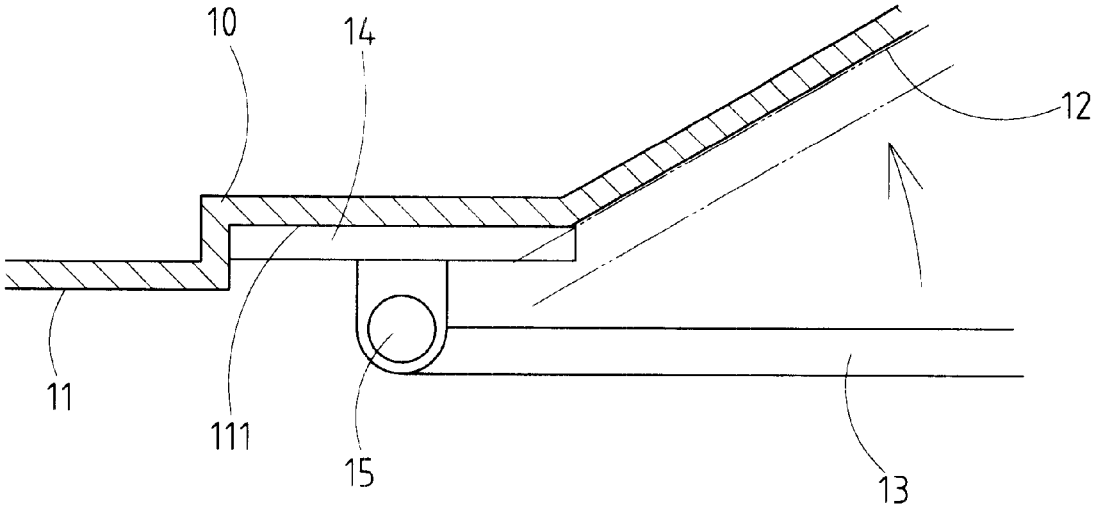
FIG.2 PRIOR ART
FIG. 2 shows a partial sectional view of the golf bag base of the prior art as shown in FIG. 1.
Figure 3:
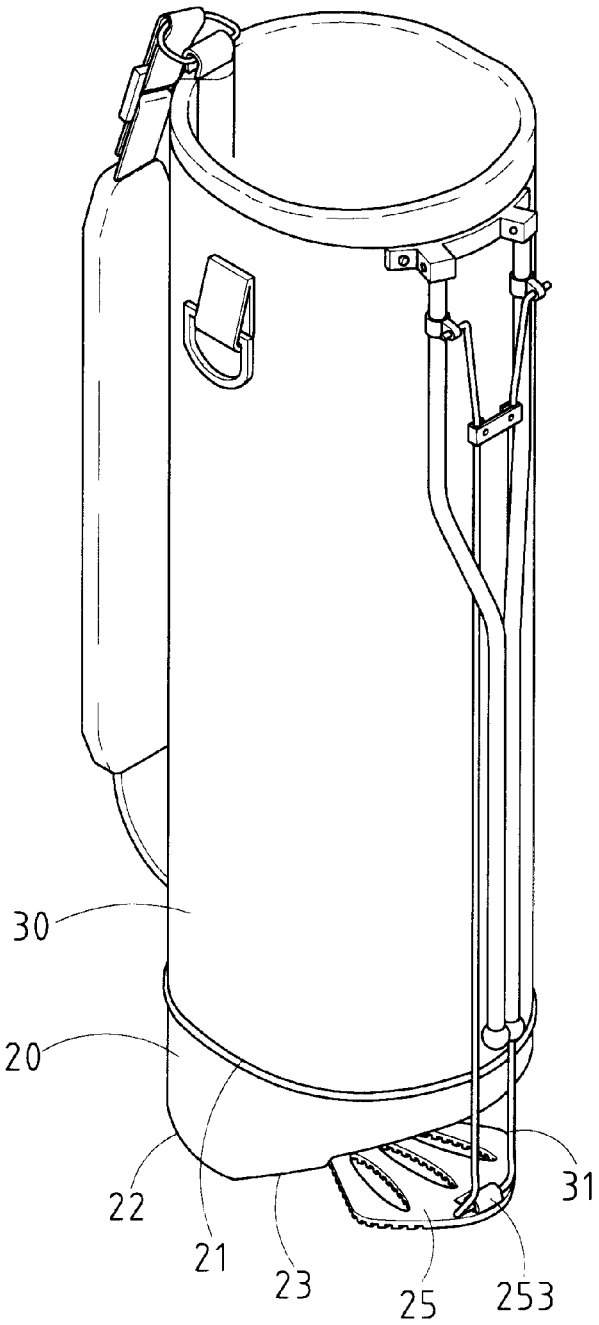
FIG. 3 shows a perspective view of a golf bag base of the preferred embodiment of the present invention.
Figure 4:
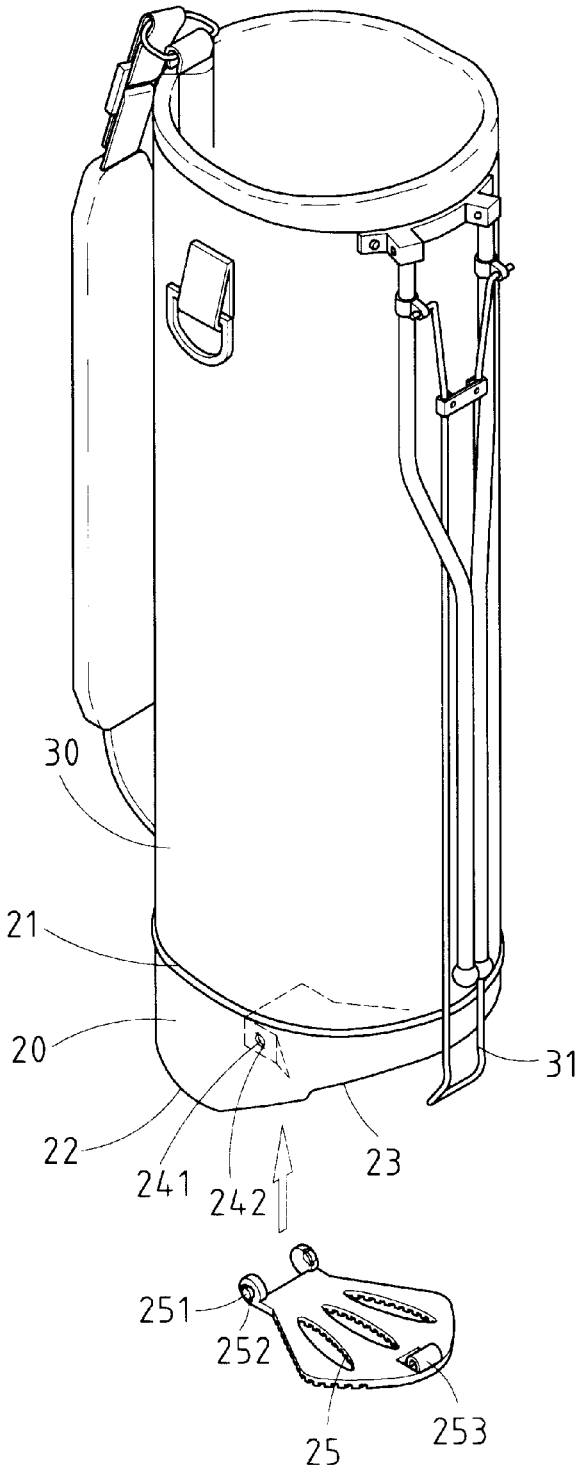
FIG. 4 shows an exploded view of the golf bag base of the preferred embodiment of the present invention.
Figure 5:
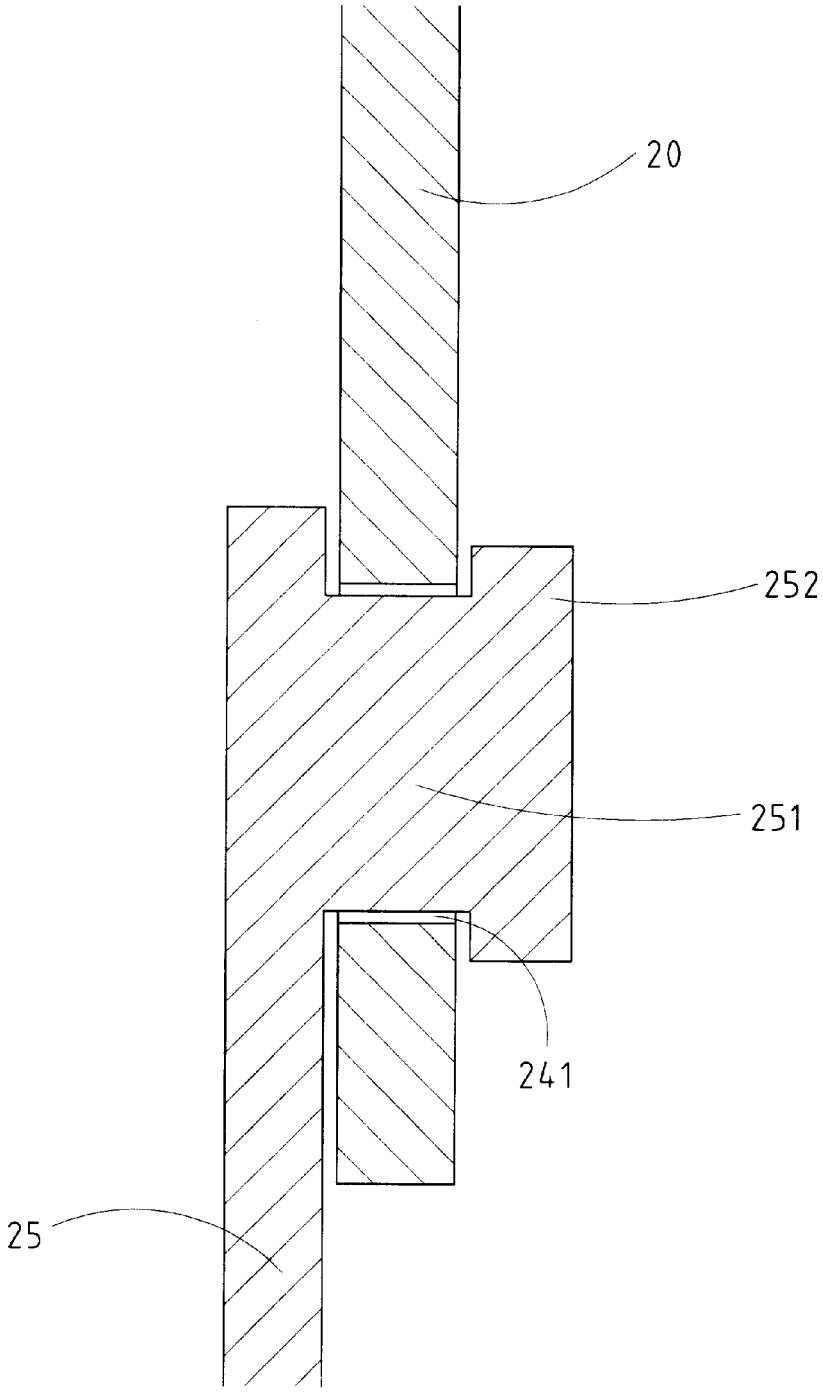
FIGS. 5–9 are partial sectional views of the golf bag base of the preferred embodiment of the present invention.
Figure 6:
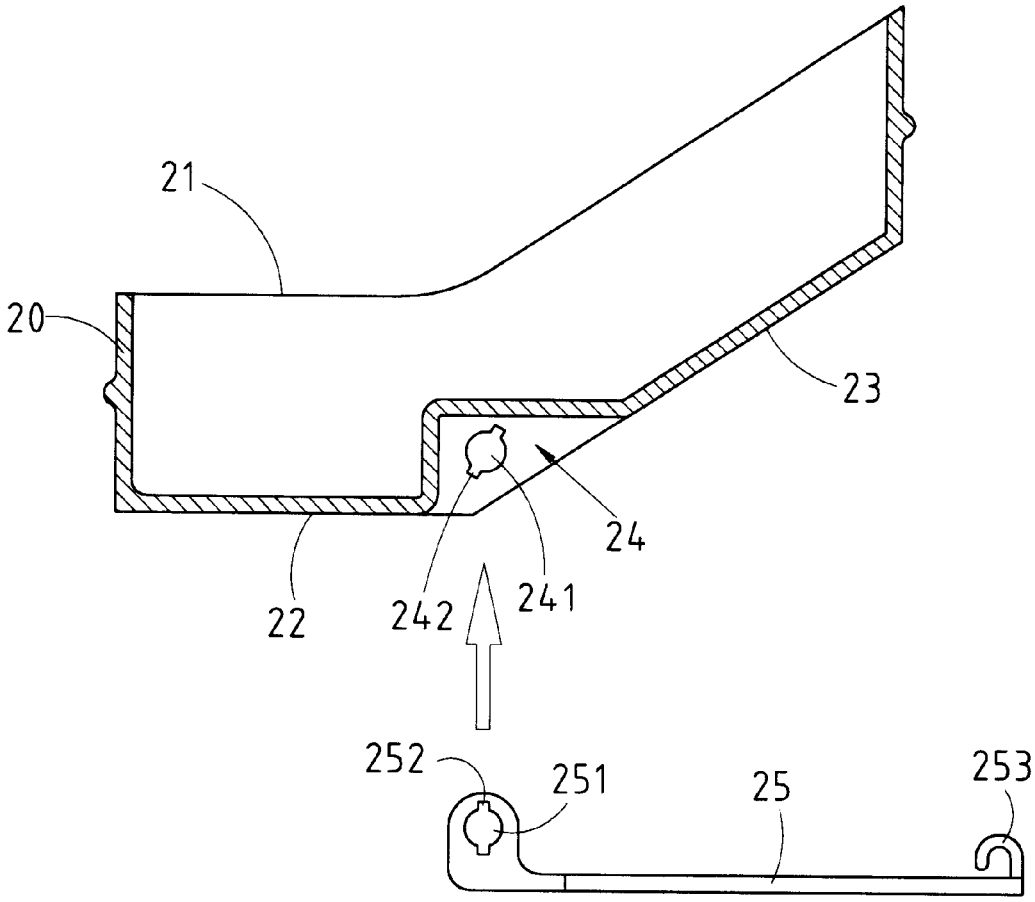
Figure 7:
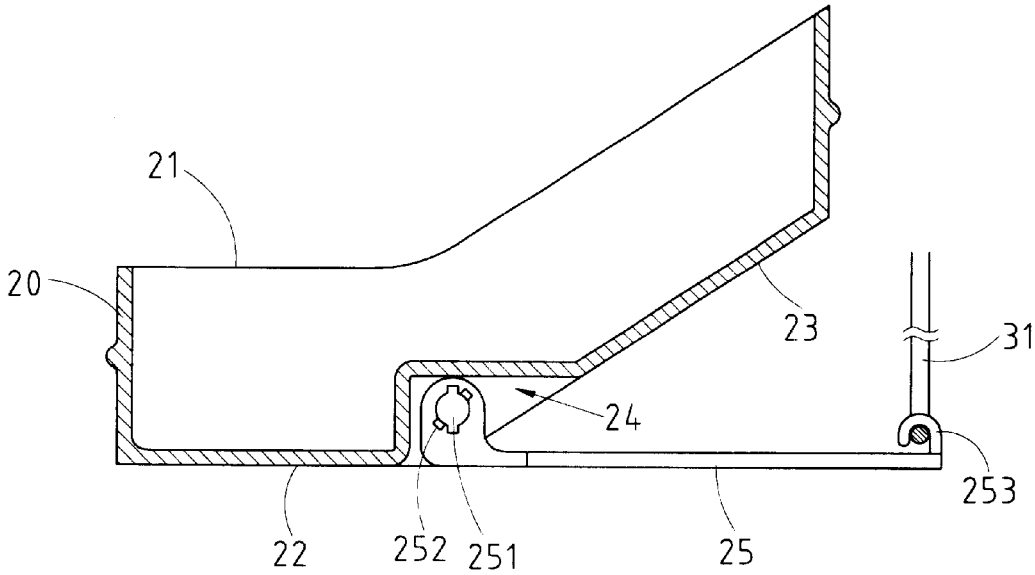
Figure 8:
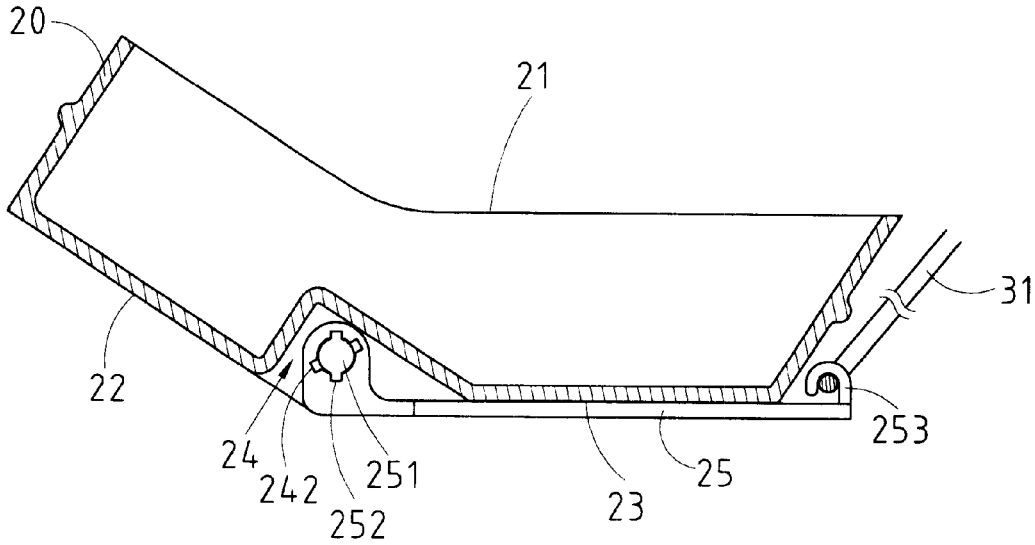
Figure 9:
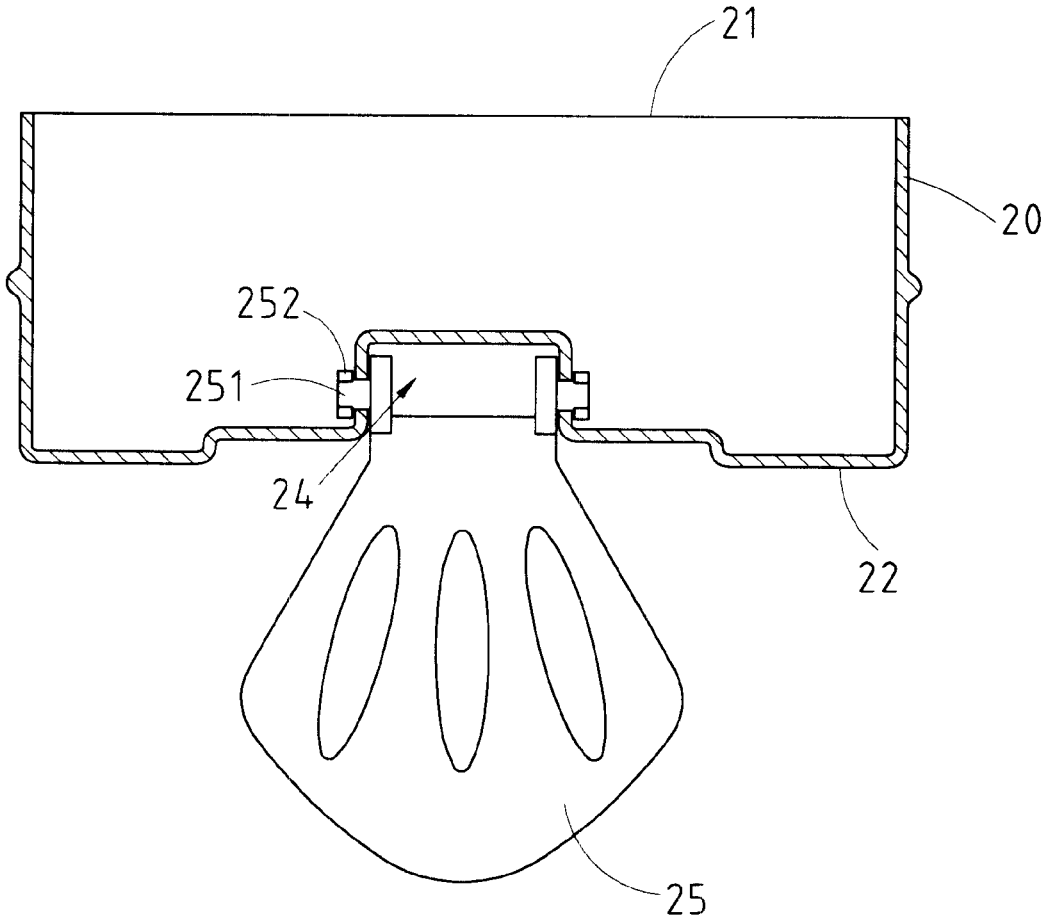
Figure 10:
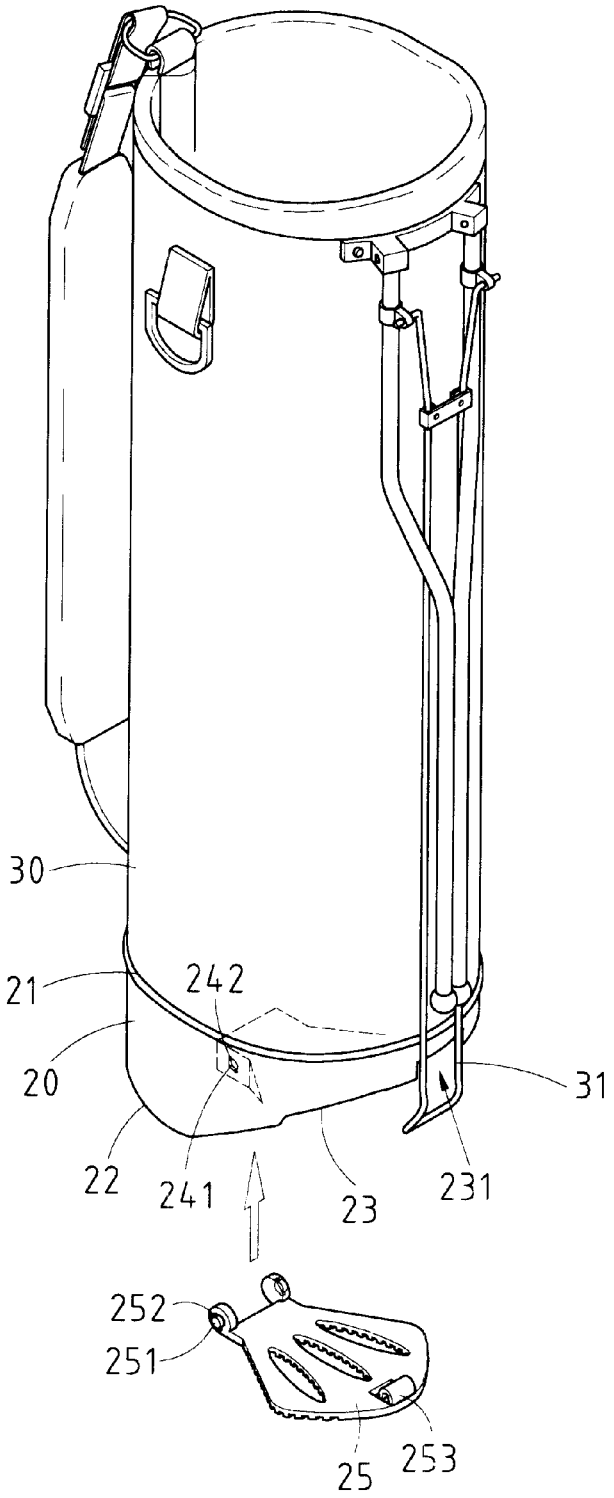
FIG. 10 shows a schematic view of the assembly of the action plate and the main body of the base of the preferred embodiment of the present invention.

As shown in FIGS. 3–11, a golf bag base of the preferred embodiment of the present invention comprises a main body 20, and an action plate 25 pivoted to the main body 20. The upper side 21 of the main body 20 is used to support a golf bag 30. The golf bag 30 has an action rod 31 which is retained at the bottom end thereof by the action plate 25.

The main body 20 has a horizontal underside 22 and an inclined underside 23 contiguous to the horizontal underside 22. The horizontal underside 22 is provided with a receiving slot 24 which is in turn provided in the inner wall thereof with two pivoting holes 241 opposite in location to each other, with each of the two pivoting holes 241 having a wing indentation 242.

The action plate 25 is provided with two pivoting projections 251 opposite in location to each other, with each of the two pivoting projections 251 having a wing block 252 corresponding to the wing indentation 242 of the receiving slot 24 of the main body 20. The action plate 25 is pivoted to the main body 20 such that the two pivoting projections 251 of the action plate 25 are received in the two pivoting holes 241 of the receiving slot 24 of the horizontal underside 22 of the main body 20. The wing blocks 252 of the pivoting projections 251 of the action plate 25 serve to confine the position of the action plate 25 in relation to the main body 20. In addition, the wing blocks 252 of the action plate 25 serve to prevent the action plate 25 from being separated from the main body 20, as illustrated in FIGS. 5–9. The action plate is provided with a retaining block 253, which is used to retain the bottom end of the action rod 31.

Figure 11:
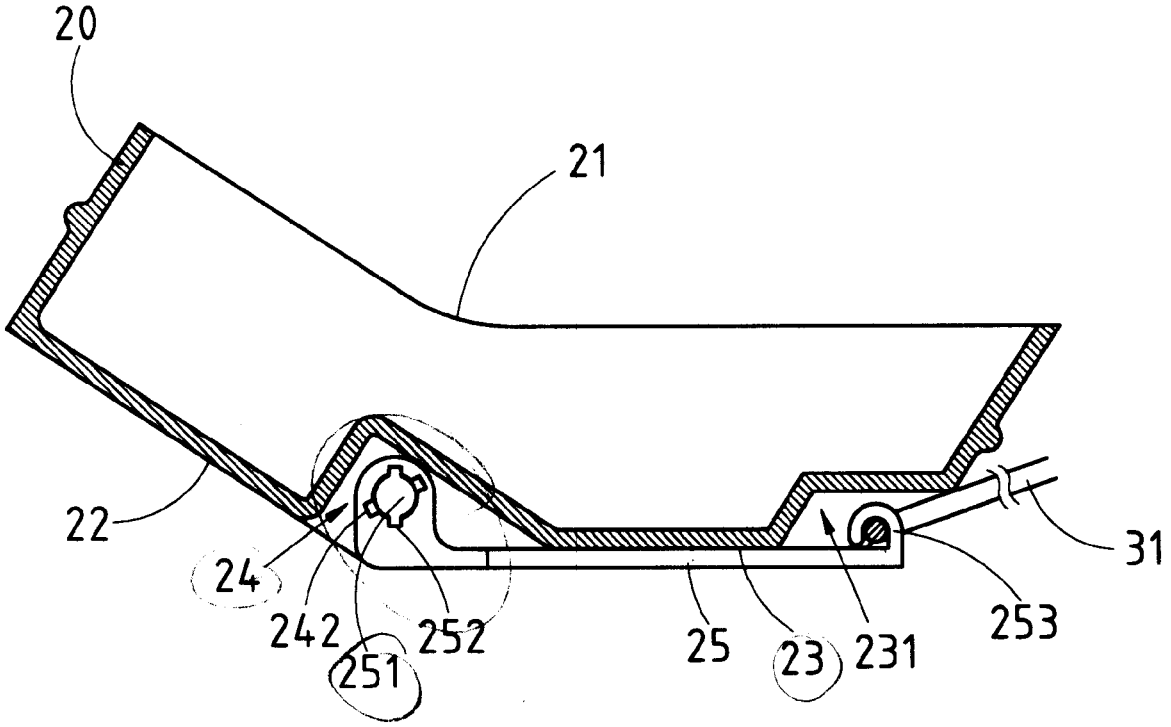
FIG. 11 shows a sectional view of the assembly of the action plate and the main body of the golf bag base of the preferred embodiment of the present invention.

As shown in FIG. 11, the inclined underside 23 of the main body 20 is provided with a recess 231 which is intended to accommodate the retaining block 253 of the action plate 25.

The main body 20 and the action plate 25 of the preferred embodiment of the present invention may be made separately or integrally.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following claims.

I claim:

1. An apparatus:

a golf bag having an action rod extending therefrom;

a main body having an upper side affixed to a bottom of said golf bag, said main body having an underside with a horizontal portion and an inclined portion extending upwardly from said horizontal portion; an action plate having a pair of ear members extending in spaced parallel relationship from a back end of said action plate, said action plate having a retaining block formed in a top side thereof, said retaining block releasably retaining said action rod therein, said underside of said main body having a receiving slot formed therein, said receiving slot having a pair of walls opposite in location to each other, each of said pair of walls having a pivot hole formed therein, the pivot hole having a wing opening formed therein and extending radially outwardly therefrom, each of said pair of ear members having a pivoting projection extending outwardly therefrom, the pivoting projection rotatably received in the pivot hole, the pivoting projection having a wing block of a size suitable for slidable insertion through said wing opening, said wing block positioned on an outer surface of the wall of said receiving slot, the ear member being positioned against an inner surface of the wall of said receiving slot, the pivoting projection extending through the pivot hole, said action plate movable between a first position in planar alignment with said horizontal portion of said underside of said main body and a second position juxtaposed against said inclined portion of said main body, the wing block being angularly offset from the wing opening in either of the positions of said action plate.

2. The apparatus of claim 1, said inclined portion of said main body having a recessed area at a forward edge thereof, said retaining block positioned within said recessed area when said action plate is in said second position.

* * * * *